United States Patent [19]

Keen et al.

[11] 3,969,647

[45] July 13, 1976

[54] CATHODE RAY TUBE ELECTRICAL CONNECTIVE TRAVERSAL INCORPORATING INTERNAL SHIELDING AND CONTACT MEANS

[75] Inventors: Allan W. Keen, Waterloo; Joseph B. Shinal, Seneca Falls, both of N.Y.

[73] Assignee: GTE Sylvania Incorporated, Stamford, Conn.

[22] Filed: Feb. 10, 1975

[21] Appl. No.: 548,268

Related U.S. Application Data

[63] Continuation of Ser. No. 419,768, Nov. 28, 1973, abandoned.

[52] U.S. Cl. ..... 313/477 HC; 313/318

[51] Int. Cl.[2] ..... H01J 29/00; H01J 31/00

[58] Field of Search ..... 313/477, 482

[56] References Cited

UNITED STATES PATENTS

| | | | |
|---|---|---|---|
| 2,499,834 | 3/1950 | Phelps | 174/50.53 |
| 2,820,166 | 1/1958 | Pinotti | 313/318 |
| 3,450,920 | 6/1969 | Engels et al. | 313/482 |
| 3,582,978 | 6/1971 | Petersen et al. | 313/482 |
| 3,626,232 | 12/1971 | Ohgoshi et al. | 313/477 X |

*Primary Examiner*—Robert Segal
*Attorney, Agent, or Firm*—Norman J. O'Malley; Frederick H. Rinn; Cyril A. Krenzer

[57] ABSTRACT

A configurated expanse of metal is provided for orientation within a cathode ray tube envelope, attachment thereof being made with the interior surface of the electrical connective button located substantially in the funnel portion of the tube. The metallic expanse is shaped to provide regional shielding of the area involving the traversal button, and effects increased areal contact between the coating disposed on the internal surface of the envelope and the traversal button sealed therein.

2 Claims, 4 Drawing Figures

CATHODE RAY TUBE ELECTRICAL CONNECTIVE TRAVERSAL INCORPORATING INTERNAL SHIELDING AND CONTACT MEANS

CROSS-REFERENCE TO RELATED APPLICATION

This application is a continuation of Ser. No. 419,768, filed Nov. 28, 1973, now abandoned.

BACKGROUND OF THE INVENTION

This invention relates to an electrical connective traversal oriented in the wall of a cathode ray tube envelope and more particularly to structural means integral with the connective traversal to effect increased areal contact with internal coating in the tube and to provide regional radiation shielding of the traversal area of the envelope.

In cathode ray tubes, especially those utilized in color television applications, there has been a trend to increase the operating anode potentials. For example, in the larger sizes of display tubes it is common practice to utilize anode voltages in excess of 20 KV. With the increase in anode voltage there is also a resultant increase in x-radiation emission, such being generated by the high velocity electrons striking metallic objects within the tube such as the shadow mask and/or the aluminum film disposed in the viewing panel region of the tube. The x-rays so generated are randomly radiated in diverse directions such as towards the viewing panel and back into the funnel region of the envelope. The glass of the viewing panel is formulated to contain specific additive elements, such as lead and/or strontium, to attenuate the transmission of x-rays therethrough. The glass composition of the funnel portion of the envelope also contains additive elements for attenuating the transmission of x-rays. Furthermore, the glass comprising the funnel and viewing panel portions is of a sufficient thickness and mass to achieve a satisfactory balance for both tube strength and x-ray attenuation. However, the glass surrounding the electrical connective traversal oriented in the wall of the envelope, such as the anode connector button, is reduced in thickness resultant of the procedure for sealing of the metallic connector to the glass. Thus, the seal area of this connective traversal exhibits less x-ray attenuation than the adjacent areas of the picture tube envelope. In addition, there is a tendency for the traversal button per se to permit the transmission of problematic x-radiation therethrough. Therefore, to remedy this undesirable radiation situation, television receiver manufacturers have found it necessary to use an external connective means which is provided with a terminal shielding cap or cover made of a material to attenuate x-ray radiation emanating from this area of the tube envelope.

The electrical traversal, such as the high voltage second anode button, is a hollow member comprised of a substantially frusto-conical body, the bottom surface of which is oriented within the interior of the envelope. In the completed tube, the internal surface of the funnel portion of the envelope is provided with an essential electrical conductive coating, such as Aquadag, which intentionally makes contact with the bottom surface of the button member. The high voltage anode potential required for tube operation is applied to this interior coating from a source external of the tube by means of a terminal connection externally attached to the traversal button. The nature of the hermetic seal between the wall of the traversal button and the contiguous glass of the funnel portion is conducive to the formation of re-entrant angles therebetween, whereat coating difficulties are sometimes encountered. When deep re-entrants are formed at this seal region, poor coating adherence is an inherent resultant; a condition which produces inadequate electrical conduction between the connective button and the interior conductive coating. In addition, under higher anode voltage operation, any borderline condition, relative to the adequacy of electrical contact between the button and the coating, is more susceptible to breakdown, thereby creating an inferior connection and a potentially deleterious arcing situation within the tube.

OBJECTS AND SUMMARY OF THE INVENTION

It is an object of the invention to reduce the aforementioned disadvantages of the prior art. It is another object of the invention to provide internal regional shielding of the traversal area of the envelope. It is a further object of the invention to provide means for effecting increased areal contact between the internal coating of the tube and the connective traversal.

These and other objects and advantages are achieved in one aspect of the invention by the provision of an internally oriented metallic expanse formed relative to the internal contour of the envelope. The expanse is configurated to superjacently cover the connective traversal region to provide x-radiation shielding therefor and make positive contact with the conductive coating disposed on the interior surface of the tube envelope. Attachment means is provided to securely affix the formed metallic expanse to the bottom surface of the traversal.

DESCRIPTION OF THE PREFERRED EMBODIMENT

Figure 1:
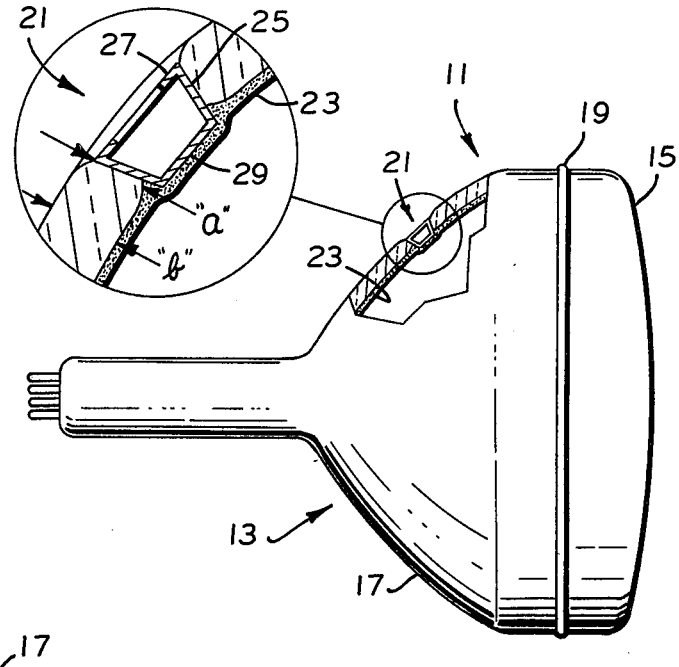
Fig. 1 PRIOR ART
FIG. 1 is a prior art view of a cathode ray tube whereof an exposed cross-sectional portion illustrates the electrical connective traversal region of the envelope.

For a better understanding of the present invention, together with other and further objects, advantages and capabilities thereof, reference is made to the following disclosure and appended claims in connection with the aforedescribed drawings. With particular reference to FIG. 1, there is shown a prior art view of a cathode ray tube 11, whereof the encompassing envelope 13 comprises a viewing panel portion 15 which is hermetically sealed to the funnel portion 17, as by glass frit, along the seal-line 19. A cutaway of the drawing reveals a sectional area of the funnel portion wherein an electrical connective traversal 21 is hermetically oriented in the wall thereof. In the instance shown, the traversal is in the form of a high voltage anode button, the interior or bottom surface of which makes contact with a graphite or Aquadag electrical conductive coating 23 disposed over the interior wall of the funnel portion. While an anode button is delineated, the breadth of the invention is intended to also include connective traversals for other electrical functions which may be required in accordance with the structure of the tube. In conventional form, the anode button 21 is usually comprised of a substantially frusto-conical body having a circumferential sidewall 25 which is sealed into the glass wall of the envelope. Additionally, the structure of the button includes substantially parallel spaced apart top and bottom portions, 27 and 29 respectively, which being integral with the sidewall form a rigid hollow member. It is to be noted that the thickness "*a*" of the funnel glass contiguous to the circumferential sidewall 25 of the button is markedly reduced from the normal thickness "*b*" of the sidewall glass. This localized reduction in glass thickness is resultant of the procedure wherein a substantially circular section of the funnel sidewall is discretely removed, whereupon the metallic buttontype traversal member 21 is inserted into the opening and peripherally sealed to the defining sidewall. The metallic material of the traversal button has a coefficient of thermal expansion that substantially matches that of the contiguous glass of the funnel portion 17. A suitable material is one such as No. 4 Alloy, which is an alloy of nickel and iron, commercially available from GTE Sylvania Incorporated, Warren, Pa.

Figure 2:
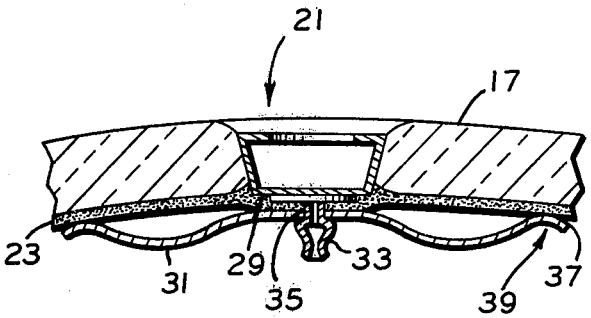
FIG. 2 is an enlarged sectional of the connective traversal region of the envelope illustrating the formed metallic expanse of the invention and means for attaching the expanse to the traversal.

With reference to FIG. 2, which is an enlarged sectional showing the connective traversal region of the envelope wherein the metallic expanse 31 is illustrated as being attached to the bottom portion 29 of the traversal button. This expanse, which provides the dual functions of shielding the traversal member and adjacent funnel region along with effecting increased area contact with the envelope coating, is contoured to be compatible with the internal contour of the associated envelope surface. While the expanse component 31 may be of any areal shaping that is in contactual keeping with the contour of the envelope, usually a substantially round or ovate disc formation is appropriate for the application. To achieve positive placement, it is preferable that the metallic expanse 31 has a degree of resilience to maintain a predetermined configuration. For example, stainless steel of a 0.010 inch thickness is adequate in certain instances, but in a broader sense, additional materials and diverse thicknesses are also to be considered to enable the tube manufacturer to meet radiation limits in tubes of various sizes and applications. As shown in FIG. 2, the configurated expanse is held in positive seating placement by a resilient clip-type securement 33 which is attached to the bottom 29 of the connective traversal member 21, the expanse component having a substantially centrally oriented aperture 35 therein to accommodate the protrusion of the clip member 33 therethrough. Being so secured, the configurated expanse is shaped to provide x-radiation shielding of the traversal and adjacent region, and make positive contact with the envelope coating in two spaced apart areas. The peripheral area of contiguous pressured contact 37 between the expanse 31 and the conductive coating 23 is achieved in substantially the perimetrical region 39 of the expanse and may be continuous or intermittent thereabout, whereof portions of the expanse make contact with the coating, such being determined by the specific configuration of the expanse. The attachment of the clip-type resilient member 33 to the bottom of the traversal button 21 may be accomplished prior to sealing of the button into the funnel portion 17, or the clip may be attached after the button is sealed into the funnel prior to the application of the internal coating 23. The configurated expanse is subsequently secured by the clip member after the funnel and button area have been coated with the conductive Aquadag material. Preferably, the assembly operation involves vertical placement of the expanse member on the clip to avoid undue abrasion of the envelope coating.

Figure 3:
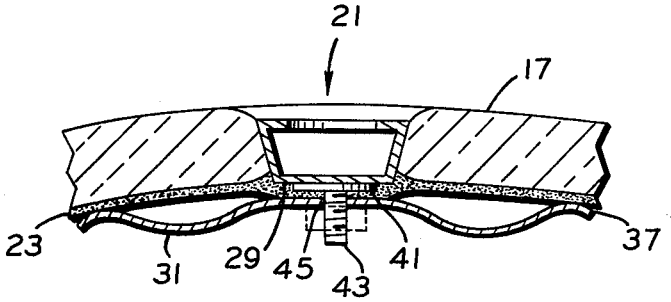
FIGS. 3 and 4 illustrate additional sectional views of the invention showing other embodiments for attaching the metallic expanse to the traversal.

Another embodiment of an attachment means for securing the metallic expanse 31 is delineated in FIG. 3. This particular attachment means is in the form of a threaded member 41 affixed to the bottom surface 29 of the connective traversal in a manner whereof the threaded element 43 protrudes therefrom. The configurated expanse 31 has an aperture 45 formed therein to accommodate the protrusion of the threaded element therethrough thereby effecting securement of the expanse. The aperture may be of a dimension to effect frictional securement on the threaded member, or the size of the expanse aperture may be such as to facilitate securement of the expanse on the threaded member by a nut-like mating member 47. As with the previously described resilient clip securing means 33, the threaded member 41 may be bonded to the traversal button 21 prior to sealing of the button in the funnel portion of the envelope; or the threaded member may be bonded to the bottom surface 29 of the button after the button is sealed into the funnel prior to deposition of the conductive coating 23 thereover.

Figure 4:
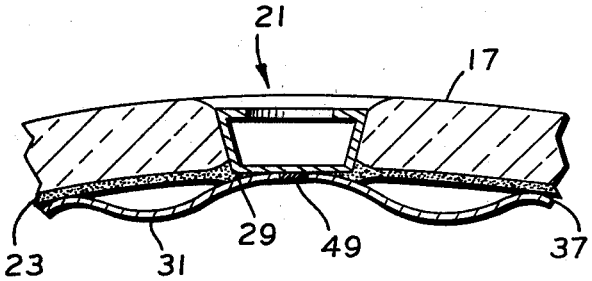

Another embodiment of securement of the metallic expanse 31 to the traversal button 21 is shown in FIG. 4, wherein the configurated expanse is bonded as by a weld 49 to the bottom surface of the button after the funnel portion has been coated with Aquadag material. This securement is effected by removing the coating material 23 from the bottom surface of the button and slightly abrading the exposed surface to remove the oxide coating therefrom thereby expediting the bonding or welding procedure.

Thus, there is provided a metallic expanse member that efficiently effects internal regional shielding of the traversal member and adjacent area of the envelope, and affords increased areal contact between the internal coating of the tube and the connective traversal. While the configurated expanse is assembled or attached to the connective traversal during tube manufacturing, the attachment means associated with the button components may be affixed thereto by the button manufacturer, the glass funnel manufacturer or the tube manufacturer depending upon which procedure is most expeditious and desirable.

While there has been shown and described what is at present considered the preferred embodiments of the invention, it will be obvious to those skilled in the art that various changes and modifications may be made therein without departing from the invention as defined by the appended claims.

What is claimed is:

1. In a cathode ray tube wherein an electrical conductive coating interiorly disposed on at least a portion of the wall of the encompassing envelope makes substantial contact with the planar bottom surface of an electrical connective traversal positioned in the wall of said envelope and exposed to the interior of said envelope, an improvement therein in the form of structural contact and shielding means disposed integral to the interiorly oriented planar bottom surface of said traversal to effect increased areal contact in a plurality of areas with said priorly disposed coating and to additionally provide regional radiation shielding of the traversal area, said improvement means comprising:

a resilient metallic member formed to have a configurated expanse related to the shaping of the internal contour of said envelope whereof at least two areal portions of said member make positive pressured contact with said coating, said member having a planar central area formed in a manner compatible with the planar bottom surface of said traversal, the expanse of said member being configurated to superjacently cover said traversal region; and bonding attachment means to effect a contiguous planar seated jointure between said member and said traversal whereby the planar central portion of said member is securely affixed to a bare central area of the planar bottom surface of said traversal to provide positive seating contact with the coating thereat and peripherally spatially therefrom.

2. The improvement in the cathode ray tube structural contact and shielding means according to claim 1 wherein the expanse of said member is peripherally shaped in a manner whereof intermittent portions make positive contact with said coating.

* * * * *